US010106933B2

(12) United States Patent
Keightley et al.

(10) Patent No.: US 10,106,933 B2
(45) Date of Patent: Oct. 23, 2018

(54) UNIVERSAL SLIDE-PLATE

(71) Applicant: Narstco Inc., Midlothian, TX (US)

(72) Inventors: Sean Keightley, Waxahachie, TX (US); Michael Del Guerrero, Waxahachie, TX (US); Steven Glenn Smith, Waxahachie, TX (US)

(73) Assignee: NARSTCO, INC., Midlothian, TX (US)

( * ) Notice: Subject to any disclaimer, the term of this patent is extended or adjusted under 35 U.S.C. 154(b) by 281 days.

(21) Appl. No.: 15/154,078

(22) Filed: May 13, 2016

(65) Prior Publication Data

US 2016/0355991 A1 Dec. 8, 2016

Related U.S. Application Data

(60) Provisional application No. 62/163,249, filed on May 18, 2015.

(51) Int. Cl.

| | |
|---|---|
| ***E01B 9/00*** | (2006.01) |
| ***E01B 9/66*** | (2006.01) |
| ***E01B 7/22*** | (2006.01) |
| *E01B 7/00* | (2006.01) |
| *E01B 9/32* | (2006.01) |

(52) U.S. Cl.

CPC ..... *E01B 9/66* (2013.01); *E01B 7/22* (2013.01); *E01B 7/00* (2013.01); *E01B 9/32* (2013.01); *E01B 2202/025* (2013.01)

(58) Field of Classification Search

CPC ..... E01B 9/60; E01B 9/62; E01B 9/66; E01B 5/18; E01B 7/22; E01B 7/00

USPC ..... 238/17

See application file for complete search history.

(56) References Cited

U.S. PATENT DOCUMENTS

| | | | | | |
|---|---|---|---|---|---|
| 1,761,256 | A * | 6/1930 | Evans | E01B 7/22 | 246/453 |
| 4,174,820 | A * | 11/1979 | Kempa | B61L 5/065 | 104/130.01 |
| 5,918,806 | A * | 7/1999 | Keightley | E01B 9/34 | 238/108 |
| 6,158,698 | A * | 12/2000 | Click | E01B 7/22 | 238/62 |
| 6,997,419 | B1 * | 2/2006 | Remington | E01B 5/16 | 238/288 |
| 8,985,526 | B2 * | 3/2015 | Brushwood | B61L 5/107 | 246/430 |
| 2007/0108308 | A1 * | 5/2007 | Keightley | E01B 3/46 | 238/29 |
| 2007/0272803 | A1 * | 11/2007 | Steinmann | B61L 5/10 | 246/430 |
| 2008/0302881 | A1 * | 12/2008 | Porrill | E01B 9/58 | 238/287 |
| 2015/0136865 | A1 * | 5/2015 | Walter | E01B 2/003 | 238/345 |
| 2016/0355991 | A1 * | 12/2016 | Keightley | E01B 9/66 | |

* cited by examiner

*Primary Examiner* — Jason C Smith
(74) *Attorney, Agent, or Firm* — Workman Nydegger

(57) ABSTRACT

A universal slide-plate includes a body and a drop-in shoulder member with a plurality of retaining members that cooperate to selectively connect the universal slide-plate and a stock rail to a rail platform and/or tie. The universal slide-plate has a slide surface configured to support a moveable point rail thereon. The universal slide-plate may be selectively removed and repositioned relative to a rail platform and/or tie.

20 Claims, 12 Drawing Sheets

UNIVERSAL SLIDE-PLATE

CROSS REFERENCE TO RELATED APPLICATION

The present application claims priority to and the benefit of U.S. Provisional Application No. 62/163,249 entitled "UNIVERSAL SLIDE-PLATE" and filed May 18, 2015, the disclosure of which is incorporated herein by reference.

BACKGROUND OF THE DISCLOSURE

Railroads use switches to change railcars from one set of rails to another set of rails while the railcars are moving along the rails. A switch has stationary rails and movable rails that are located between the stationary rails. The movable rails are "point rails." The stationary rails are "stock rails." The point rails direct a railcar through the switch onto one set of rails or the other set of rails. In a switch, the point rails are tapered rails that move laterally in plane with the stock rails. The point rails may move between two, or in some cases more, positions to direct a railcar onto a set of rails. The switch may have a straight "through" track (i.e., the main line) and a diverging track. The diverging track may be a left-hand diverging track or a right-hand diverging track. The approach track (i.e., the set of rails before the switch) has a left rail and a right rail. The left rail and right rail of the approach track may both be continuous through the switch and may be the stock rail for both the through track and the diverging track. For example, in a right-hand diverging switch, the left rail of the approach track may continue straight and may be the stock rail for the through track. The right rail of the approach track may diverge to the right and be the stock rail for the right-hand diverging track.

The left point rail and right point rail may be mechanically locked relative to one another such that the point rails move simultaneously and maintain a consistent distance from one another. The point rails may move together such that only one of the point rails may be adjacent or "connected" to one of the stock rails at a time. The wheels of a railcar follow the connected point rail and the stock rail that is disconnected from the point rails. In the right-hand diverging switch example, the left point rail may be connected to the left or through stock rail while the right point rail may be disconnected from the right or diverging stock rail. The wheels may follow the diverging track. Conversely, if the point rails are moved such that the left point rail is disconnected from the through stock rail and the right point rail is connected to the diverging stock rail, the wheels of a railcar truck may follow the through track.

The switch may be operated by a switchstand or a switch machine. The switchstand or switch machine may be located on the left side or the right side of the switch. The switchstand or switch machine may be located on the through side of the switch or on the diverging side of the switch. The switchstand or switch machine may be connected to the switch mechanically to move the point rails. The location of the switchstand or switch machine may change due to the location and/or orientation of the switch relative to other structures or natural features. For example, a station may contain many rail lines that may interconnect or simply cross in a multitude of directions.

The rails, both stock and point, are supported by a railroad tie that distributes the weight of the rail and the cars across a larger area and into the ground. The tie may have a rail plate affixed thereto to allow the securement of the rail to the tie. Construction or repairs at a station may result in modifications to planned or existing designs for a switch direction or a switchstand or switch machine location. Alteration of the switch direction or switchstand or switch machine location in a conventional switch may require replacement of the tie and/or the rail-plate with a new tie and/or new rail plate specific to the new configuration.

BRIEF SUMMARY OF THE DISCLOSURE

This summary is provided to introduce a selection of concepts that are further described below in the detailed description. This summary is not intended to identify specific features of the claimed subject matter, nor is it intended to be used as an aid in limiting the scope of the claimed subject matter.

In a first non-limiting embodiment, a device for supporting a rail includes a body, a drop-in shoulder member, and a first retaining member. The body has a top surface, a first end, a second end, a bottom surface, a forward surface and a rearward surface. The body also has a first shoulder connected to the top surface and a first connection member affixed to the bottom surface proximate the first end of the body. The body has a slide surface and a stock surface on the top surface. The drop-in shoulder member has a second connection member and is configured to abut the body. The first retaining member is configured to connect to the drop-in shoulder member and contact the top surface proximate the second end.

In a second non-limiting embodiment, a system for supporting a rail includes a rail platform, a slide-plate having a body and a drop-in shoulder member, and a retaining member. The rail platform has a top plate. The top plate has a plurality of openings. The slide-plate has a body with a top surface configured to support a point rail and a bottom surface with a first connection member configured to mate with at least two of the plurality of openings. The drop-in shoulder member has a second connection member configured to mate with at least two of the plurality of openings and the drop-in shoulder member is configured to abut the body. The retaining member is configured to connect to the drop-in shoulder member and contact the top surface proximate the second end. In some embodiments, the rail platform is fixed to a steel tie.

In a third non-limiting embodiment, a kit includes a first straight slide-plate, a second straight slide-plate, a first diverging slide-plate, and a second diverging slide-plate. The slide-plates may include a body, a drop-in shoulder member, and a first retaining member. The body has a top surface, a first end, a second end, a bottom surface, a forward surface and a rearward surface. The body also has a first shoulder connected to the top surface and a first connection member affixed to the bottom surface proximate the first end of the body. The body has a slide surface and a stock surface on the top surface. The drop-in shoulder member has a second connection member and is configured to abut the body. The first retaining member is configured to connect to the drop-in shoulder member and contact the top surface proximate the second end.

Additional features of embodiments of the disclosure will be set forth in the description which follows. The features of such embodiments may be realized by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

One or more specific embodiments of the present disclosure will be described below. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

One or more embodiments of the present disclosure may generally relate to constructing and installing a railroad switch. A switch may include one or more slide-plates configured to support a point rail or other movable rail member. The point rail may move between a connected configuration and a disconnected configuration. The slide-plate may support the point rail as the point rail moves across a slide surface of the slide-plate. The slide plate may also include a stock surface that is configured to receive a stock rail. The slide-plate may be connectable to a rail platform with a plurality of openings that allow a single slide-plate to be connected thereto in a plurality of configurations, and may allow a variety of slide-plates having different configurations to be connected thereto. In at least one embodiment, an interchangeable and/or universal slide-plate system may reduce costs and construction time for railroad operations.

Figure 1:
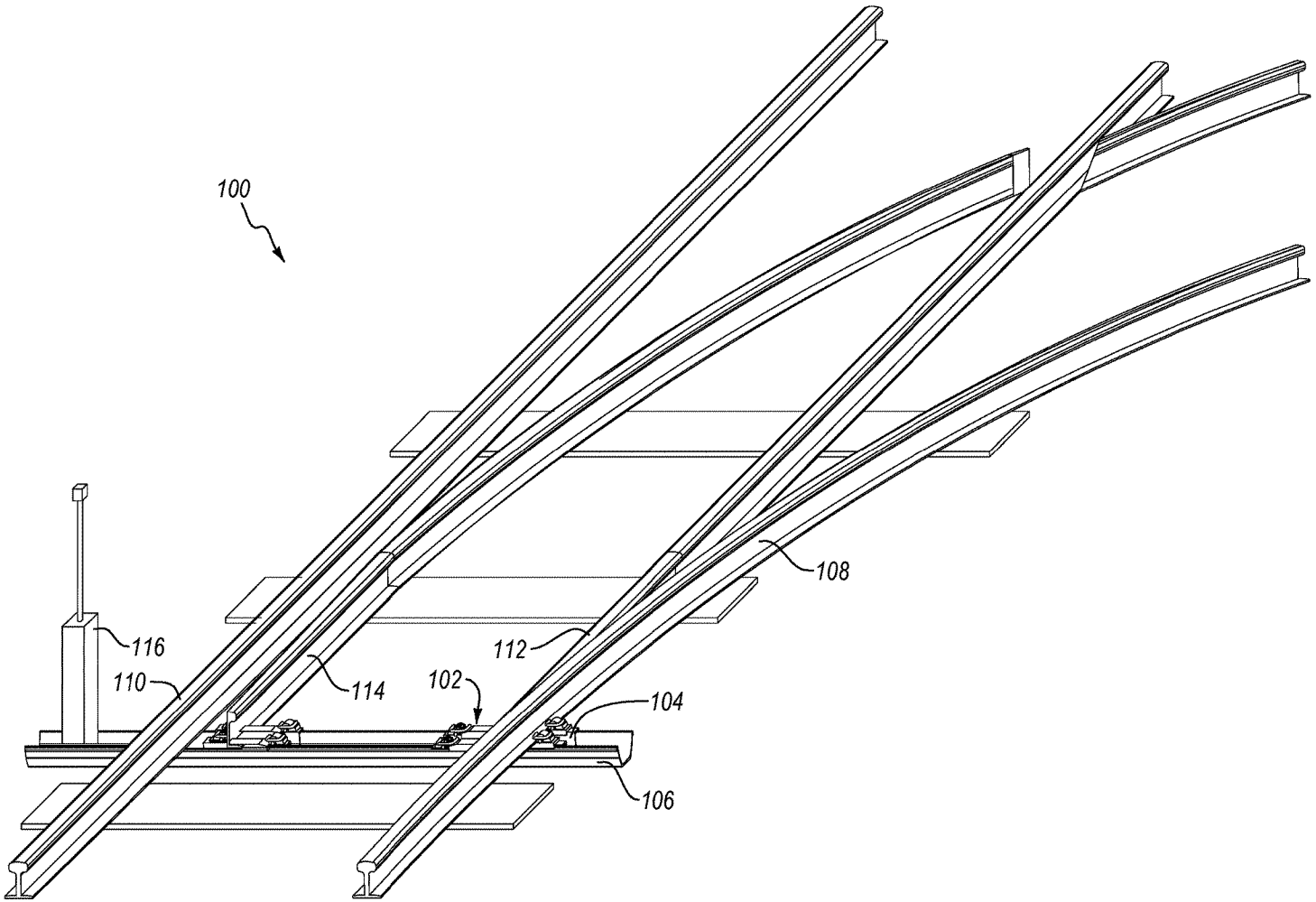
FIG. 1 is a perspective view of a railroad switch including a plurality of universal slide-plates, according to the present disclosure.

FIG. 1 illustrates an embodiment of a switch 100 including a plurality of universal slide-plates 102 and rail platforms 104. The rail platforms 104 may be affixed to a tie 106. The rail platforms 104 may be affixed to the tie 106 by a variety of methods including, but not limited to welding; brazing; adhesives; mechanical fasteners, such as bolts, screws, rivets, etc.; or combinations thereof. The rail platforms 104 may be affixed to the tie 106 to limit or, in some cases, prevent movement of the rail platforms 104 relative to the tie 106. The tie 106 may distribute at least part of the weight of the switch 100 and any cars (not shown) that may use the switch 100 to the ground via ballast, sub-ballast, and sub-grade positioned around and/or below the tie 106. The tie 106 may include any appropriate material and may have any form to distribute weight from the switch 100 to the ground. In some embodiments, the tie 106 may be a metal tie. For example, the tie 106 may be a steel tie and may have a trough shape to distribute weight. In other embodiments, the tie 106 may be a wooden tie, a concrete tie, a composite tie, or other tie. While embodiments described in the present disclosure may refer to a steel tie, it should be understood that other ties may be used The plurality of universal slide-plates 102, rail platforms 104, and tie 106 may support a diverging stock rail 108 and a through stock rail 110. The diverging stock rail 108 may be a left diverging stock rail or a right diverging stock rail. While the switch 100 is depicted as having a diverging right rail, a switch 100 including universal slide-plates 102 according to the present disclosure may also be a triple switch an equilateral switch, or other switch, including a movable rail. The switch 100 may have one or more movable rails, such as right point rail 112 and left point rail 114 depicted in FIG. 1. The right point rail 112 may be movable between a connected state, as shown in FIG. 1, and a disconnected state. The left point rail 114 may be movable between a connected state and a disconnected state, as shown in FIG. 1. In some embodiments, the right point rail 112 and left point rail 114 may be mechanically, electronically, or otherwise linked such that one of the point rails is in a connected state and the other is in a disconnected state. In other embodiments, the right point rail 112 and left point rail 114 may be mechanically, electronically, or otherwise linked such that the right point rail 112 and left point rail 114 may not be connected simultaneously. The right point rail 112 and left point rail 114 may move between a connected state and a disconnected state while in contact with one or more universal slide-plates 102.

A switchstand 116 and/or switch machine (not shown) may at least partially control the actuation of the right point rail 112 and left point rail 114 between a connected state and a disconnected state. In some embodiments, the switchstand 116 and/or switch machine may be located in a substantially transverse position relative to a direction of the diverging stock rail 108 and/or the through stock rail 110. The switchstand 116 and/or switch machine may be located on a side of the switch 100 closer to the through stock rail 110, as shown in FIG. 1, or on an opposing side of the switch 100 closer to the diverging stock rail 108. In other embodiments, the switchstand 116 and/or switch machine may located remotely to the switch 100 and configured to remotely actuate movement of the point rails.

Figure 2:
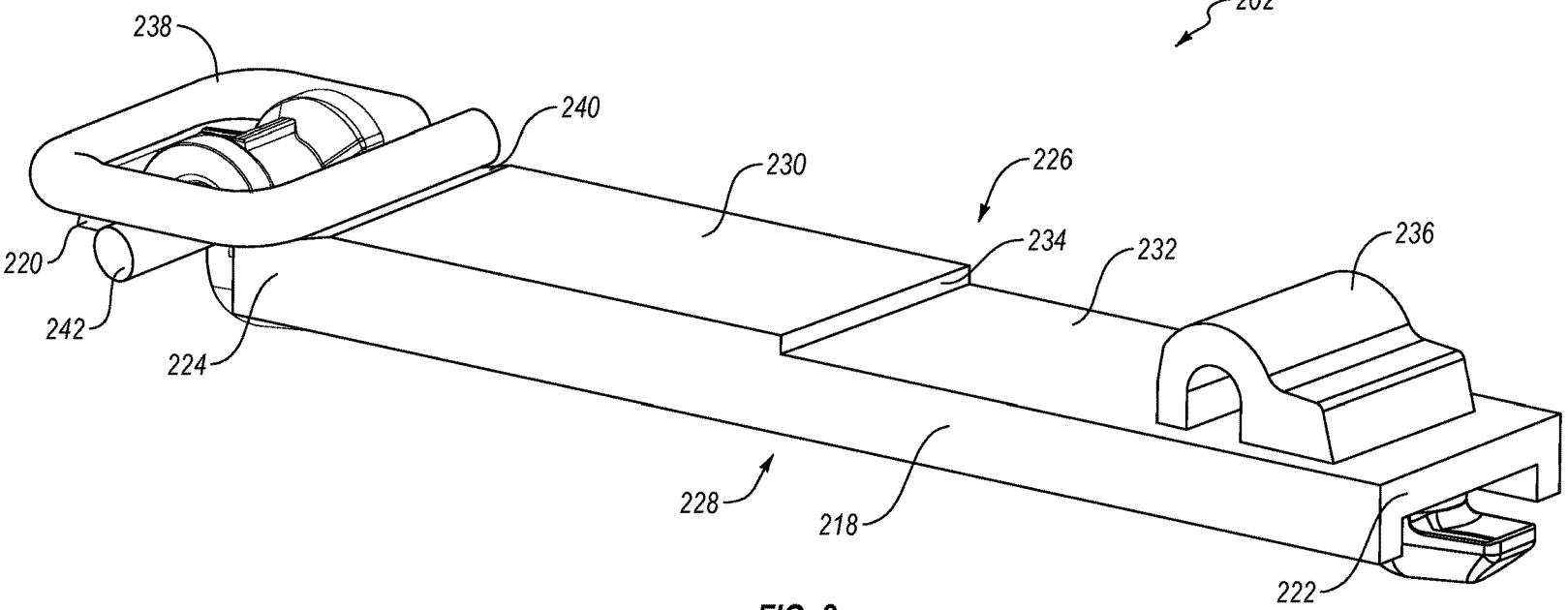
FIG. 2 is a perspective view of an embodiment of a universal slide-plate, according to the present disclosure.

FIG. 2 is a perspective view of an embodiment of a universal slide-plate 202 according to the present disclosure. The universal slide-plate 202 may include a body 218 and a drop-in shoulder member 220. The body 218 may have a first end 222 and a second end 224. In some embodiments, the second end 224 may abut the drop-in shoulder member 220, while in other embodiments, the second end 224 may be proximate to, but not abutting the drop-in shoulder member 220. The body 218 may also include a top surface 226 and a bottom surface 228. The top surface 226 may have different portions thereof, including a slide surface 230 and a stock surface 232. In some embodiments, the stock surface 232 may be recessed below the slide surface 230. In other embodiments, the slide surface 230 and the stock surface 232 may be co-planar. In yet other embodiments, the slide surface 230 may be recessed below the stock surface 232. The body 218 may have a lateral wall 234 that defines an end of the stock surface 232. The body 218 may have a first shoulder 236 that defines another end of the stock surface 232. The stock surface 232 may be sized to receive different sizes of a base of a rail. For example, the stock surface 232 may be sized to receive a 75 pound per yard (lb/yd), 85 lb/yd, 90 lb/yd, 100 lb/yd, 105 lb/yd, 115 lb/yd, 119 lb/yd, 127 lb/yd, 132 lb/yd, 133 lb/yd, 136 lb/yd, 140 lb/yd, 141 lb/yd, 155 lb/yd, or other size rail.

The body 218 may include or be made of various materials including, but not limited to, metals, metal alloys, composites, fiber-reinforced plastics, ceramics, or other materials. In some embodiments, the body 218 may include or be made of a metal alloy including any of iron, aluminum, titanium, tungsten, chromium, vanadium, manganese, magnesium, nickel, boron, molybdenum, carbon, sulfur, bismuth, copper, lead, silicon, and other alloying elements. For example, the body 218 may include steel. The body 218 may be cast or machined to provide the slide surface 230 and/or the stock surface 232. The first shoulder 236 may be cast with the body 218, machined from the body 218, or may be connected to the body 218 by welding, brazing, adhesives, drop-in (hook-in), one or more mechanical fasteners, or combinations thereof.

The universal slide-plate 202 may also include a retaining member 238 that is configured to connect to the drop-in shoulder member 220. The retaining member 238 may be a resilient clip, such as shown in FIG. 2, and configured to limit the motion of the body 218 while engaged with the drop-in shoulder member 220. In some embodiments, the retaining member 238 may limit the motion of the body 218 by applying a force to the top surface 226. In other embodiments, the retaining member 238 may limit the motion of the body 218 by applying a force to the second end 224. The retaining member 238 may contact a sloped surface 240 adjacent the slide surface 230. The sloped surface 240 may allow the retaining member 238 to apply a force to the top surface 226 while accounting for movement during usage, thermal expansion, manufacturing tolerances, other variations in placement and/or geometries, or combinations thereof. The sloped surface 240 may also be configured to direct at least a portion of the force applied by the retaining member 238 in a lateral direction. For example, the retaining member 238 may apply a force to the sloped surface 240 substantially normal to the sloped surface 240. The force applied to the slope surface 240, therefore, may have a component of the force that is lateral (expansive) between the body 218 and the drop-in shoulder member 220. A lateral force may limit the movement of the body 218 and/or the drop-in shoulder member 220 by applying a lateral force to one or more connection members 242. In some embodiments, the retaining member 238 may be a loop of resilient material that lies substantially in a single plane until elastically deformed when applied to the drop-in shoulder member 220. A retaining member 238 that lies in a single plane may reduce storage and shipping requirements. In other embodiments, such as that depicted in FIG. 3, the retaining member 338 may have one or more features lying out of plane, such as an angled portion depicted in FIG. 3, to strengthen the retaining member 338, facilitate placement and/or removal of the retaining member 338 on a drop-in shoulder member 320 or other location, or combinations thereof.

Figure 3:
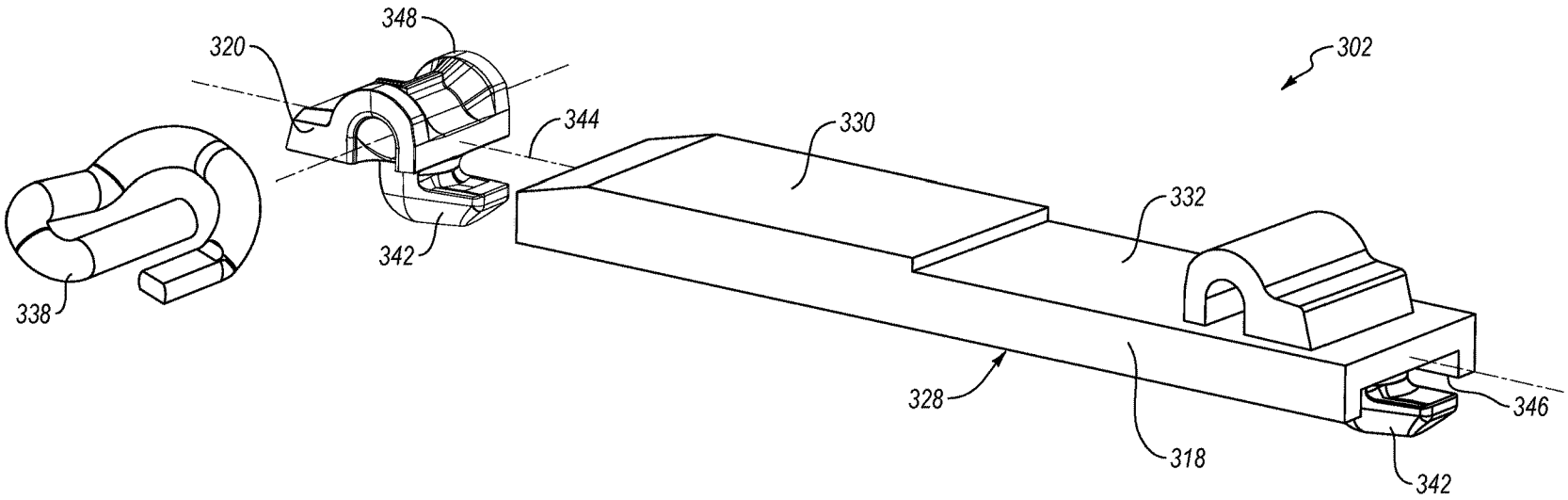
FIG. 3 is an exploded perspective view of an embodiment of a universal slide-plate, according to the present disclosure.

FIG. 3 is an exploded view of a universal slide-plate 302, according to at least one embodiment described herein. The universal slide-plate 302 may have a body 318 and a drop-in shoulder member 320. In some embodiments, the body 318 and the drop-in shoulder member 320 may align to share a common lateral axis 344. The lateral axis 344 may be substantially perpendicular to a longitudinal direction in which a rail may be laid on a stock surface 332 and/or slide surface 330 of the body 318.

The drop-in shoulder member 320 may have a connection member 342 located on a bottom surface of the drop-in shoulder member 320. In some embodiments, the connection member 342 may be a hook configured to engage with a tie laterally. A connection member 342 including a hook may be oriented such that the connection member 342 may move in a lateral direction relative to a tie. In other embodiments, the connection member 342 may be a vertical post without a hook configuration. In yet other embodiments, the connection member 342 may include a mechanical fastener to allow selective engagement with a tie or other fixed structure. For example, a mechanical fastener may include a threaded nut and a threaded portion of the connection member 342. In another example, the connection member 342 may include a movable portion such that the connection member 342 may selectively engage with a tie or other fixed structure. The connection member 342 may be configured to be selectively removable from a tie or other fixed structure to allow the universal slide-plate 302 to be positioned in a plurality of orientations relative to a tie or other fixed structure.

The connection member 342 (e.g., a hook) may limit the movement of the drop-in shoulder member 320 to the lateral direction relative to the body 318. The body 318 may have one or more connection members and/or extensions that limit or prevent the movement of the body 318 in a lateral and/or longitudinal direction. For example, the body 318 may include one or more connection members (not shown) positioned on a bottom surface 328. The one or more connection members on the body 318 may include a hook oriented in an opposing lateral direction to the connection member 342 located on the drop-in shoulder member 320. A user may engage the body 318 with a tie or other fixed structure by engaging at least a portion of the one or more connection members on the body 318 and rotating the body 318 through an arc in plane with the lateral axis 344 until the body 318 is substantially aligned with the lateral axis 344 as shown in FIG. 3. FIG. 3 depicts an embodiment of an exploded universal slide-plate 302, but the universal slide-plate 302 in operation may have the body 318 and the drop-in shoulder member 320 in contact with or substantially adjacent to one another. When in contact with or substantially adjacent to one another, the body 318 and the drop-in shoulder member 320 may be restricted or prevented from moving in a lateral direction by the plurality of connection members 342 (at least one connection member on the body 318 and at least one connection member on the drop-in shoulder member 320) engaged with a tie or other fixed structure and by the physical obstruction of the body 318 and the drop-in shoulder member 320 being laterally in contact with or substantially adjacent to one another.

The body 318 may rotate through an arc in plane with the lateral direction to disengage with the drop-in shoulder member 320 and/or a tie or other fixed structure. A retaining member 338 may limit or prevent the movement of the body 318 through such an arc. The retaining member 338 may have a portion that engages with a second shoulder 348. The second shoulder 348 may be cast with the drop-in shoulder member 320, machined from the drop-in shoulder member 320, or may be connected to the drop-in shoulder member 320 by welding, brazing, adhesives, one or more mechanical fasteners, or combinations thereof. The retaining member 338 may be a resilient clip that applies an upward force on the second shoulder 348 while applying a downward force at least on the body 318. The retaining member 338 may, therefore, be configured to limit the upward movement (rotation) of at least part of the body 318. The retaining clip 338 may, thereby, limit or prevent the only degree of freedom of either the body 318 or the drop-in shoulder member 320 when the retaining member 338 is engaged with the second shoulder 348 and at least part of the body 318.

Figure 4:
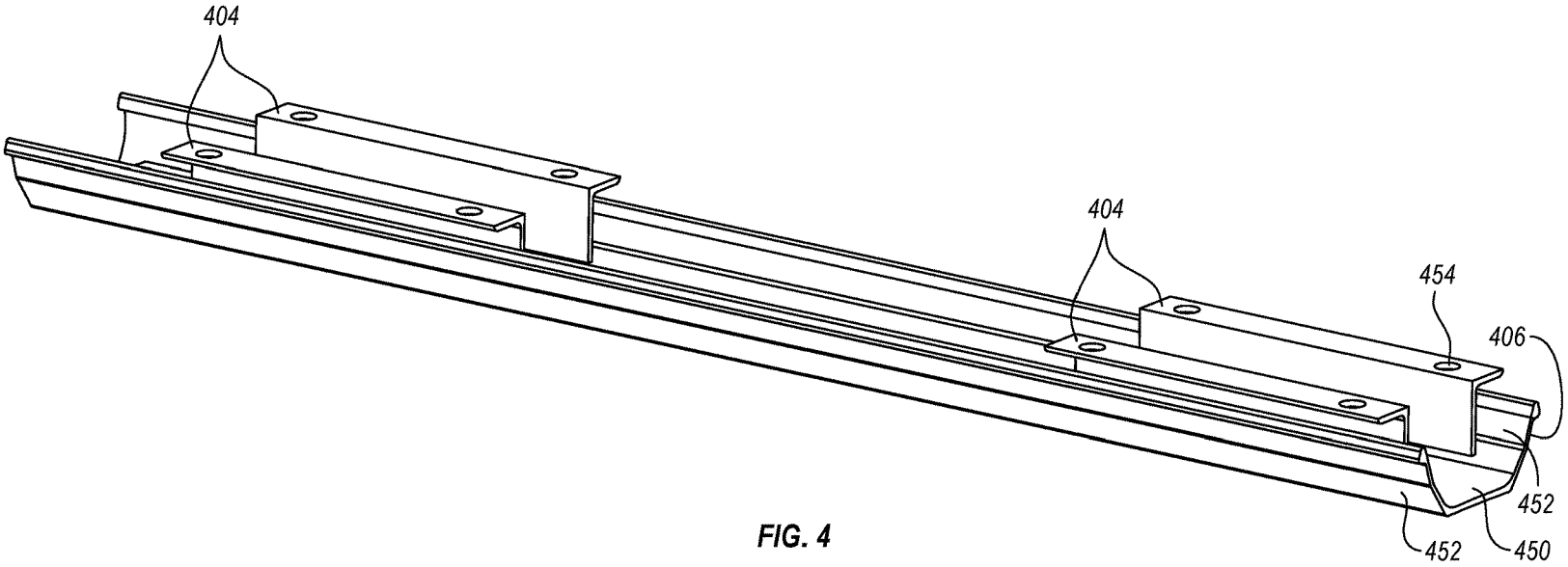
FIG. 4 is a perspective view of an embodiment of a steel tie and a rail platform, according to the present disclosure.

FIG. 4 depicts an embodiment of a tie 406 and rail platforms 404 fixed relative to the tie 406. In some embodiments, the rail platforms 404 may be individual elements that are fixed relative to the tie 406. While the present disclosure may describe the use of a plurality of rail platforms, it should be understood that in other embodiments, one or more of the rail platforms 404 may be affixed to one another to form a rail platform assembly. A rail platform 404 may be fixed relative to the tie 406 by any appropriate mechanism, such as welding, brazing, adhesives, one or more mechanical fasteners, or combinations thereof. The rail platform 404 may include or be made of a metal alloy including any of iron, aluminum, titanium, tungsten, chromium, vanadium, manganese, magnesium, nickel, boron, molybdenum, carbon, sulfur, bismuth, copper, lead, silicon, and other alloying elements. For example, the rail platform 404 may include steel. In another example, the rail platform 404 may include or be made of a weldable material.

The tie 406 may include or be made of a metal alloy including any of iron, aluminum, titanium, tungsten, chromium, vanadium, manganese, magnesium, nickel, boron, molybdenum, carbon, sulfur, bismuth, copper, lead, silicon, and other alloying elements. For example, the tie 406 may include steel. In some embodiments, the rail platform 404 and the tie 406 may be steel and the rail platform 404 and the tie 406 may be welded together. The tie 406 may have a base 450 and one or more sidewalls 452. In some embodiments, the rail platform 404 may be at least partially supported by and/or in contact with the base 450. In other embodiments, the rail platform 404 may be at least partially supported by and/or in contract with one or more sidewalls 452. In yet other embodiments, the rail platform 404 may be partially supported by and/or in contact with both the base 450 and one or more sidewalls 452. For example, FIG. 4 depicts a plurality of rail platforms 404 that are each supported by and in contact with both the base 450 and a sidewall 452, and welded thereto.

The rail platform 404 may have one or more openings 454 therein that may receive a connection member, such as connection member 342 described in relation to FIG. 3. The one or more openings 454 may allow a universal slide-plate to be mounted on the rail platform at a plurality of orientations. The rail platform 404 may transfer forces from a universal slide-plate mounted thereon to the tie 406, which may in turn transfer force to the ground upon which the tie 406 is mounted. A tie 406 may transfer force to the ground through ballast, which may be positioned on sub-ballast, which may be positioned on sub-grade. A tie 406 may support two or more rails. In some embodiments, two rail platforms 404 may support a single rail. For example, the embodiment depicted in FIG. 4 may support two or more rails, each set of rail platforms 404 supporting at least one rail.

Figure 5:
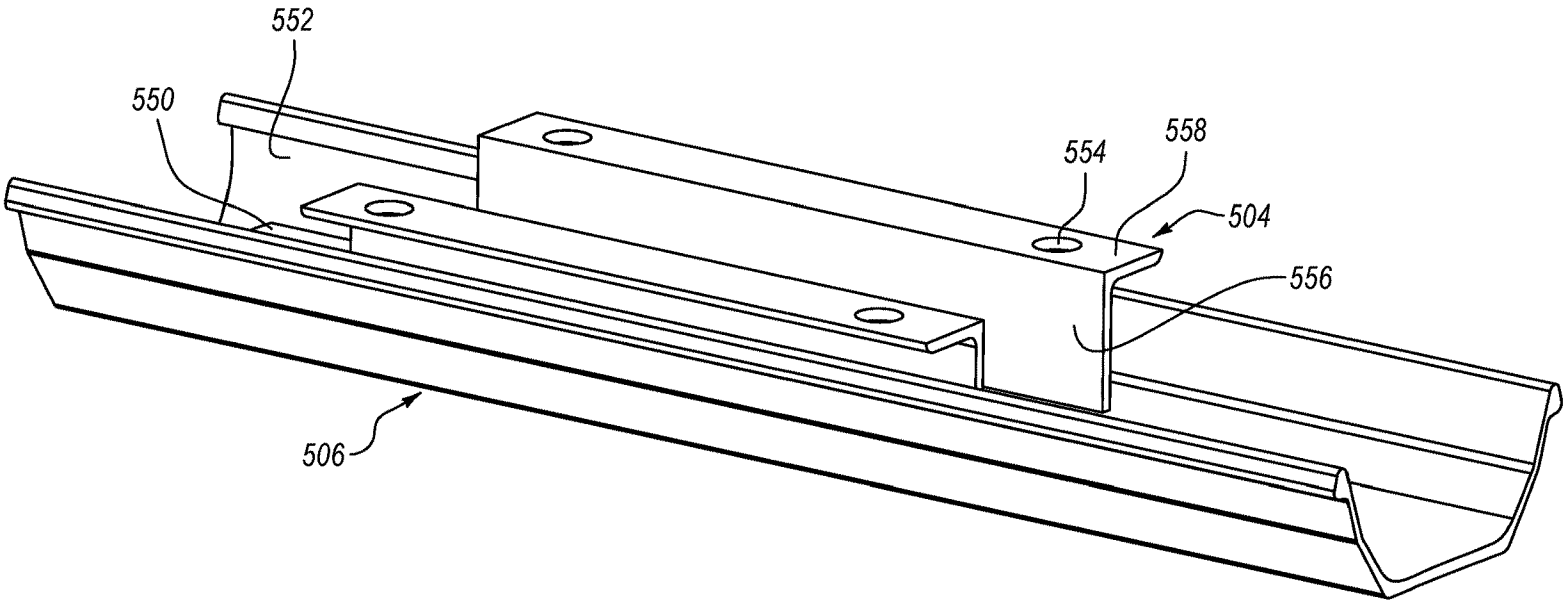
FIG. 5 is a perspective view of an embodiment of a rail platform having a plurality of openings therethrough, according to the present disclosure.

FIG. 5 is a detail view of a portion of a tie 506 having a plurality of rail platforms 504 fixed thereto, according to an embodiment as disclosed herein. The tie 506 may have a base 550 and one or more sidewalls 552. The base 550 and/or one or more sidewalls 552 may support the plurality of rail platforms 504. The rail platforms 504 may have a support plate 556 and a top plate 558. The support plate 556 may be supported by the base 550 and/or one or more sidewalls 552. The support plate 556 may be welded, or otherwise affixed, to the base 550 and/or one or more sidewalls 552 and configured to transmit force from the rail platform 504 to the tie 506. The support plate 556 may be connected to the top plate 558 or integrally formed with the top plate 558. For example, the top plate 558 and support plate 556 may be formed of a single material with a bend or curve located at an intermediate point between the top plate 558 portion and the support plate 556 portion of the rail platform 504. In some embodiments, the rail platform 504 may be a plate of steel that has been bent approximately 90° to create the top plate 558 portion and the support plate 556 portion. In other embodiments, the rail platform 504 may be two plates of steel that have been fixed relative to one another at approximately 90° to create the top plate 558 portion and the support plate 556 portion. In yet other embodiments, the support plate 556 and the top plate 558 may be oriented at different angles relative to one another.

The rail platform 504 may have one or more openings 554 therethrough. The openings 554 may be in the top plate 558 of the rail platform 504. In some embodiments, one of the one or more openings 554 may have the same dimensions as another opening 554, or the one or more openings 554 may have different dimensions. For example, the one or more openings may all be the same shape, such as circular, elliptical, square, rectangular, octagonal, irregular, or other shapes. In another example, at least one of the one or more openings 554 may have a different shape from the other openings 554, such as a circular opening and a square opening. In other embodiments, the one or more openings 554 may have different widths, lengths, areas, or combinations thereof; and some of the one or more openings 554 may have the same widths, lengths, areas, or combinations thereof. For example, one of the one or more openings 554 may have a first area and another of the one or more openings 554 may have a second area that is greater than, less than, or the same as the first area. In at least one embodiment, at least one of the one or more openings 554 in the top plate 558 may be configured to receive a connection member, such as connection member 342 described in relation to FIG. 3.

Figure 6:
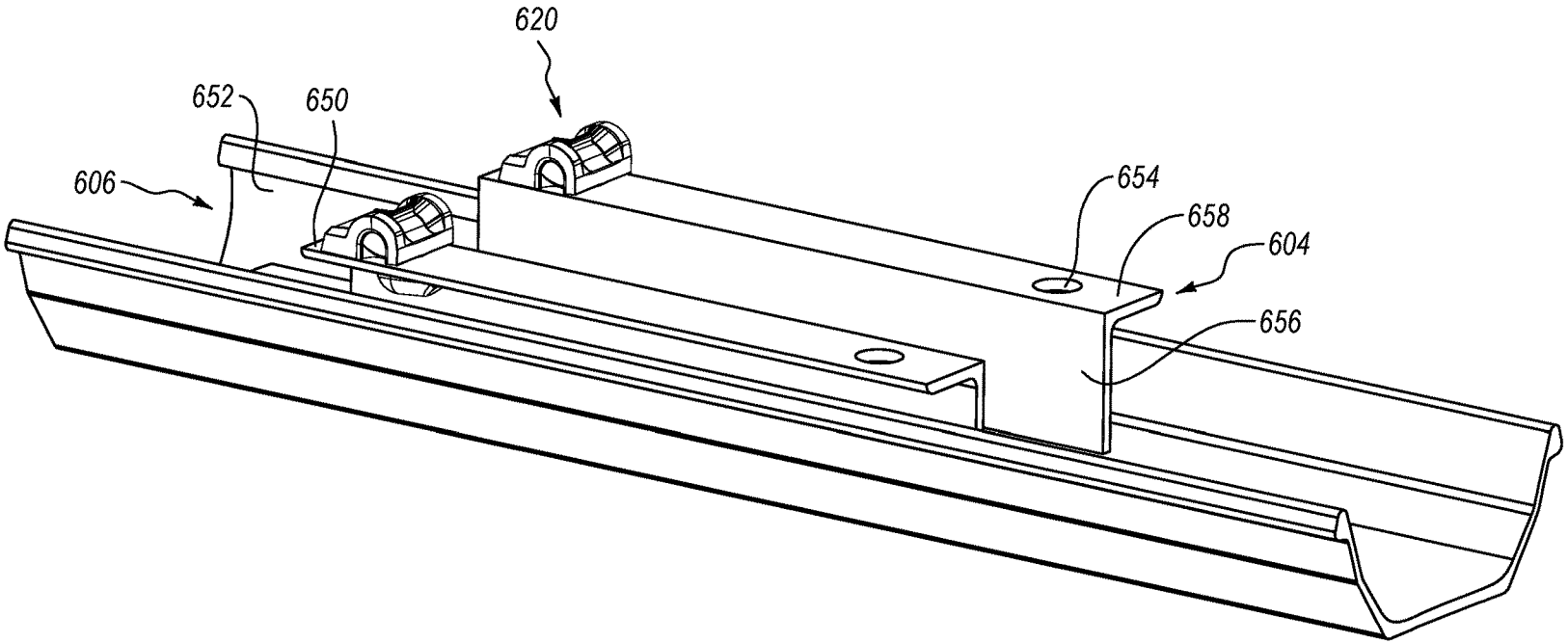
FIG. 6 is a perspective view of an embodiment of a rail platform with a drop-in shoulder connected thereto, according to the present disclosure.

FIG. 6 depicts an embodiment of a plurality of drop-in shoulder members 620 engaged with a plurality of rail platforms 604 fixed to a tie 606. The drop-in shoulder members 620 may each have a connection member, such as connection member 342 described in relation to FIG. 3, that may engage with one or more openings 654 in a top plate 658 of the rail platform 604. The drop-in shoulder member 620 may engage with one or more openings 654 in a top plate 658 and the connection member may extend beyond the top plate 658 and between the rail platform 604 and at least part of the tie 606. For example, in the depicted embodiment, the connection member on the drop-in shoulder member 620 may extend beyond the top plate 658 and into a space defined by the support plate 656, the top plate 658, a base 650 of the tie 606, and a sidewall 652 of the tie 606. In some embodiments, the rail platform 604 may be fixed relative to the tie 606 along an edge of the top plate 658. In some embodiments, the rail platform 604 may be fixed relative to the tie 606 along an edge of the support plate 656. In yet other embodiments, the rail platform 604 may be fixed relative to the tie 606 along an edge of the top plate 658 and the support plate 656.

Figure 7:
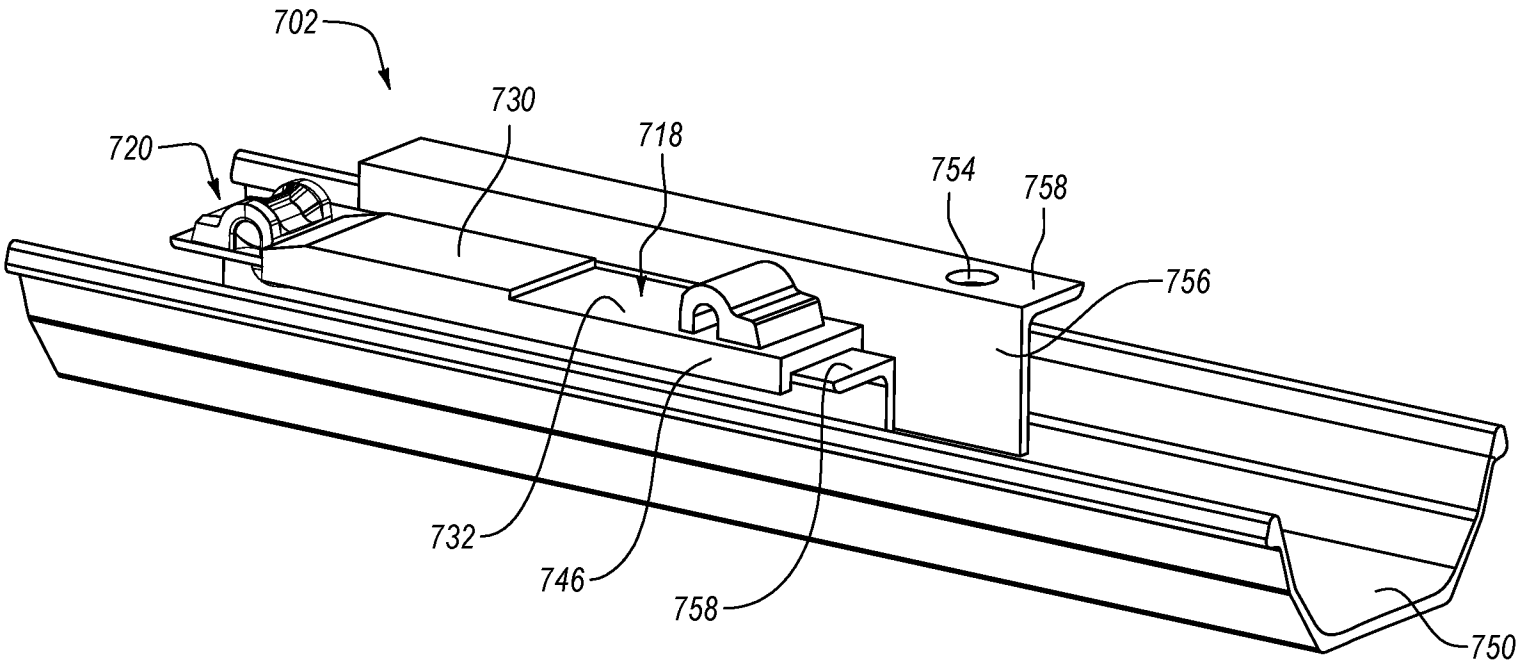
FIG. 7 is a perspective view of an embodiment of a rail platform with a universal slide-plate connected thereto, according to the present disclosure.

After the drop-in shoulder member 620 is in engaged with the rail platform 604, a body of the universal slide-plate may be connected to the rail platform, as shown in FIG. 7. A universal slide-plate 702 may be connected to a rail platform 704 and tie 706 by connecting a body 718 to the rail platform 704 in a position adjacent to and/or in contact with a drop-in shoulder member 720. The drop-in shoulder member 720 and body 718 may each have one or more connection members, such as connection member 342 described in relation to FIG. 3, that may engage with one or more openings 754 in at least one of the rail platforms 704. The body 718 may have at least one dimension greater than a top plate 758 of the rail platform 704 such that one or more extensions 746 of the body 718 may extend on either side of the top plate 758. The extensions 746 may limit the movement of the body 718 relative to the rail platform 704 in at least one direction. In some embodiments, the extensions 746 may limit the movement of the body 718 in a longitudinal direction relative to the rail platform 704 and the one or more connection members engaged with the one or more openings 754 in the rail platform 704 may limit the movement of the body 718 in a lateral direction relative to the rail platform 704. The universal slide-plate 702 may, therefore, be limited or prevented from moving relative to the rail platform 704 in a lateral and longitudinal direction. The universal slide-plate 702 may receive a force from one or more rails on the stock surface 732 and/or slide surface 730 and transmit the force through a top plate 758 and a support plate 756 to a base 750 of the tie 706. The tie 706 may distribute the force over an area of the tie 706 to the ground.

Figure 8:
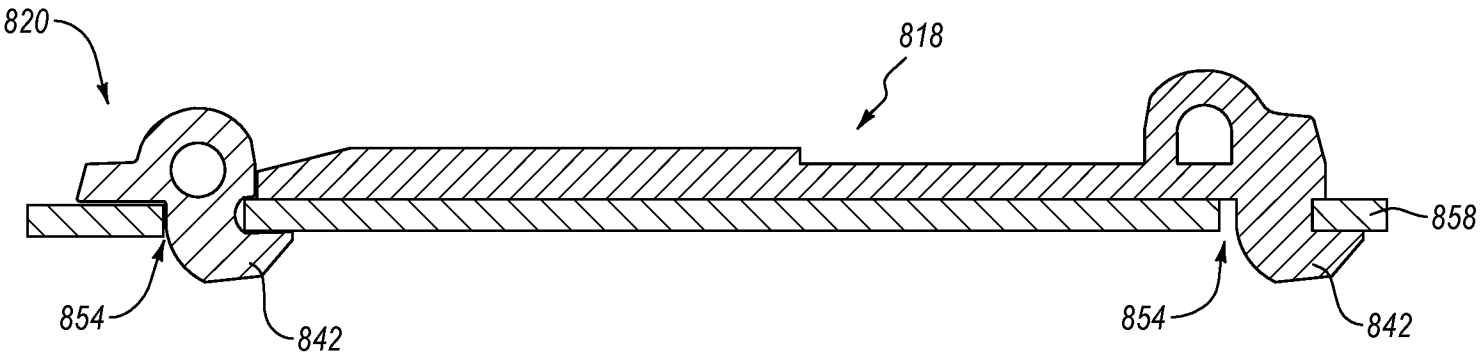
FIG. 8 is a side cross-sectional view of an embodiment of a rail platform with a universal slide-plate connected thereto, according to the present disclosure.

FIG. 8 is a cross-sectional side view of an embodiment of a universal slide-plate 802 having extensions similar to the universal slide-plate 702 described in relation to FIG. 7. The universal slide-plate 802 may include a body 818 and a drop-in shoulder member 820 that each has one or more connection members 842. The universal slide-plate 802 may engage with a top plate 858 of a rail platform through one or more openings 854 through which the one or more connection members 842 may extend. In some embodiments, the one or more openings 854 and one or more connection members 856 may be configured to be equal in number. In other embodiments, the top plate 858 may have a greater quantity of openings 854 than the universal slide-plate 802 has connection members 842 allowing for multiple placements of the universal slide-plate 802 relative to the rail platform.

Figure 9:
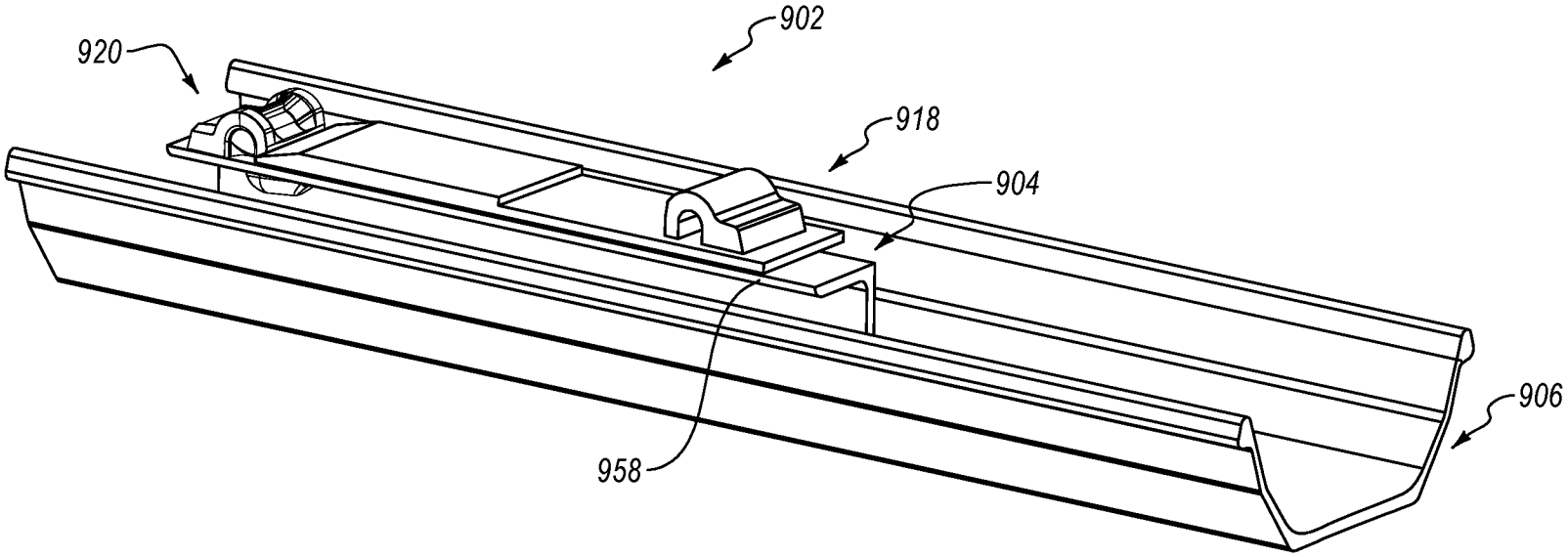
FIG. 9 is a perspective view of an embodiment of a rail platform with a universal slide-plate connected thereto by a plurality of pins, according to the present disclosure.

FIG. 9 depicts another embodiment of a universal slide-plate 902 and rail platform 904. In the depicted embodiment, the universal slide-plate 902 may have extensions that may extend through the top plate 958 of the rail platform (in contrast to the extensions 746 that may extend on either side of the top plate 758 of the rail platform 704 described in relation to FIG. 7). The movement of the universal slide-plate 902 in at least one direction relative to a tie 906 may be limited or substantially prevented by the engagement of one or more posts configured to engage with the top plate 958 of the rail platform 904. A universal slide-plate 902 having one or more posts that engage with the rail platform 904 may allow for a more compact form factor and may allow advantages in manufacturing and/or storage of the universal slide-plate 902.

Figure 10:
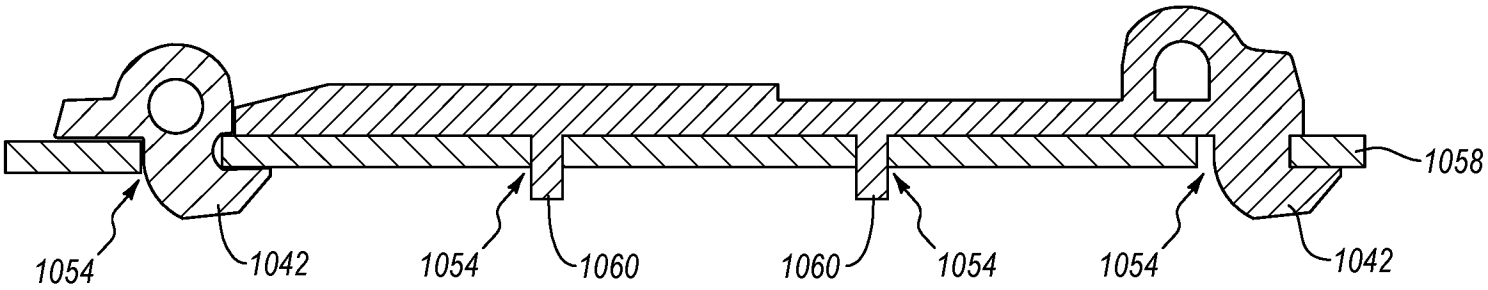
FIG. 10 is a side cross-sectional view of an embodiment of a rail platform with a universal slide-plate connected thereto by a plurality of pins, according to the present disclosure.

FIG. 10 is a cross-sectional side view of an embodiment of a universal slide-plate 1002 and rail platform 1004. The universal slide-plate 1002 may engage with a top plate 1058 of the rail platform 1004 via a plurality of openings 1054 in the rail platform 1004. The universal slide-plate 1002 may have one or more connection members 1042 that may engage with one or more of the plurality of openings 1054 to limit or substantially prevent the movement of the universal slide-plate 1002 in at least a vertical direction. The extensions of the universal slide-plate 1002 may be one or more pins 1060 configured to engage with one or more openings 1054 and to limit or substantially prevent the movement of the universal slide-plate 1002 in at least a longitudinal direction relative to the rail platform 1004.

Figure 11:
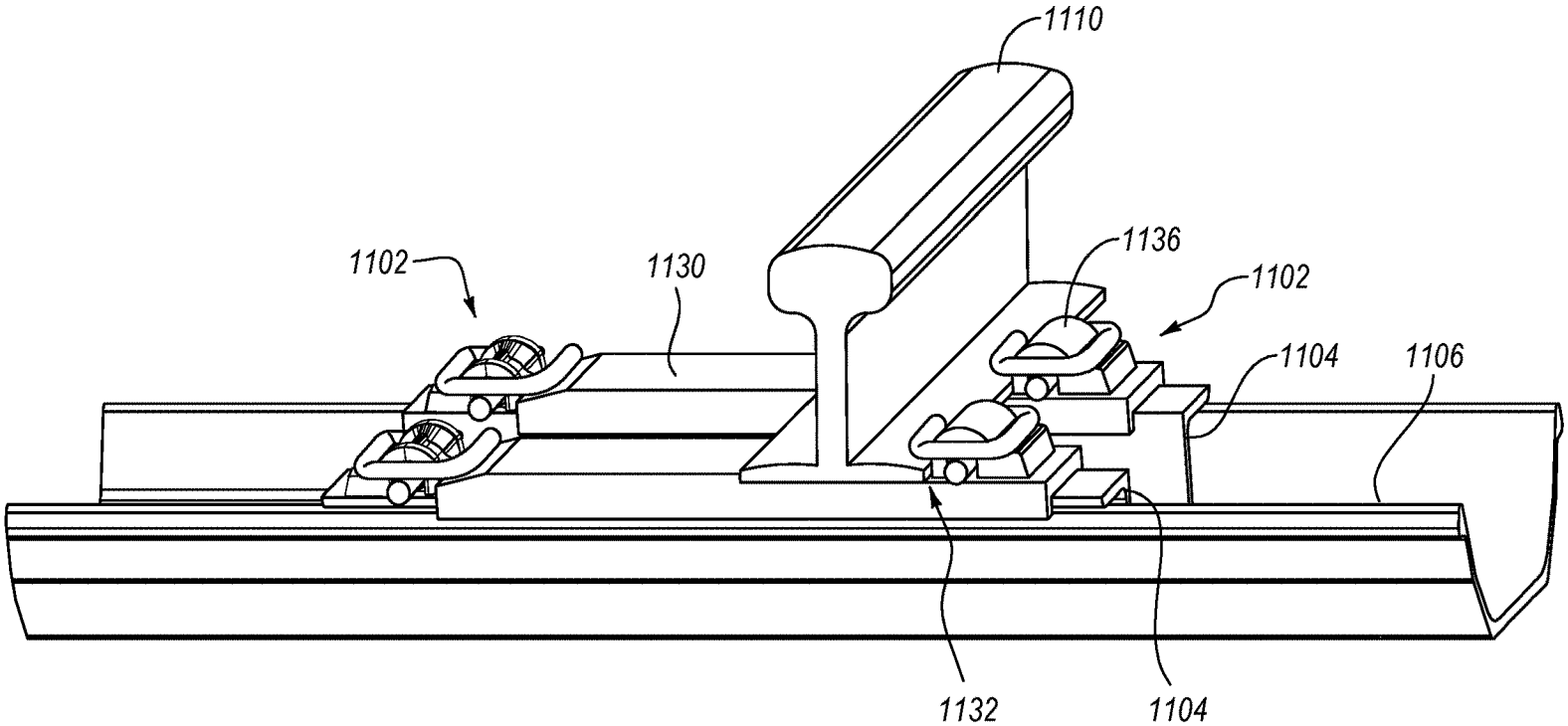
FIG. 11 is a perspective view of an embodiment of a rail platform with a universal slide-plate connected thereto and rail positioned on a surface of the universal slide-plate, according to the present disclosure.
Figure 12:
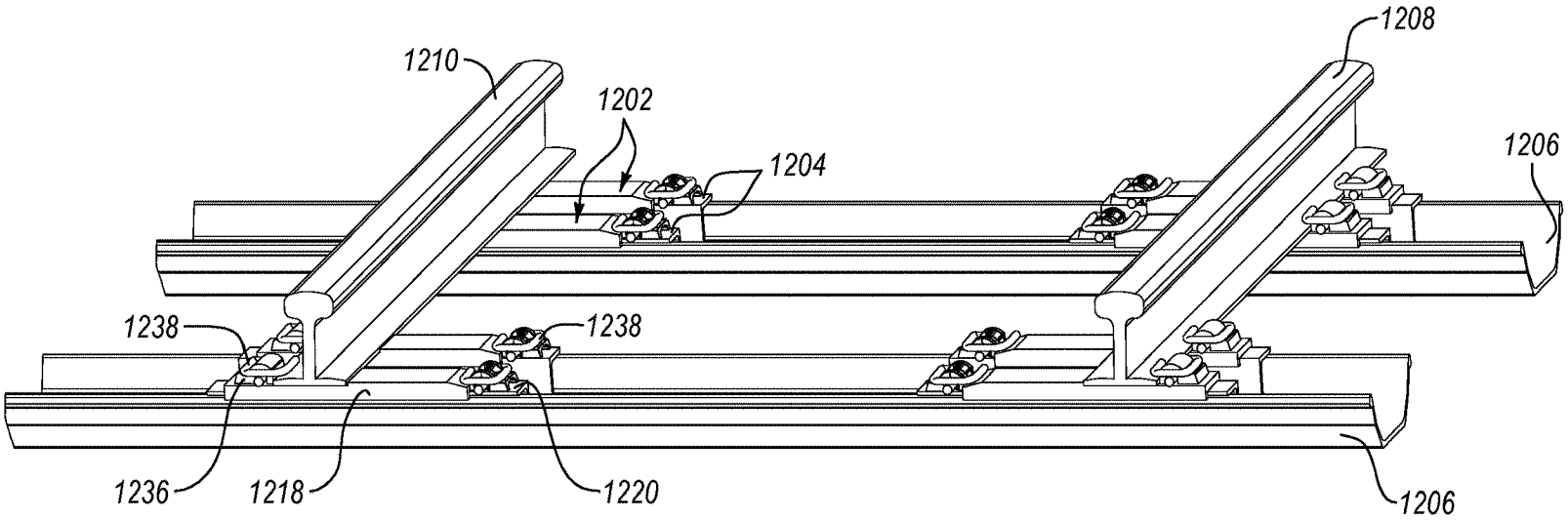
FIG. 12 is a perspective view of an embodiment of a rail tie system including a plurality of universal slide-plates, according to the present disclosure.

FIG. 11 and FIG. 12 depict the connection of a rail to an embodiment of a universal slide-plate, in accordance with the present description. FIG. 11 is a perspective view of an embodiment of a plurality of universal slide-plates 1102 affixed to a tie 1106. The plurality of universal slide-plates 1102 are affixed to the tie 1106 by one or more rail platforms 1104 welded or otherwise fixed to the tie 1106. The plurality of universal slide-plates 1102 may be aligned longitudinally (i.e., in line with the rail 1110) to provide a series of slide surfaces 1130 and stock surfaces 1132 upon which one or more rails 1110 may be supported. In the depicted embodiment, the plurality of universal slide-plates 1102 provides a plurality of stock surfaces 1132 upon which a stock rail 1110 may be supported. The stock surfaces 1132 may be between a plurality of slide surfaces 1130 and a plurality of first shoulders 1136.

In some embodiments, the plurality of slide surfaces 1130 may support a point rail that may be selectively moved adjacent to or away from the stock rail 1110. The point rail may, thereby, allow for the direction of a rail system to change. As shown in FIG. 12, a system of universal slide-plates 1202 may provide a switch in a railway system. The system of universal slide-plates 1202 may connect a diverging stock rail 1208 and a through stock rail 1210 to a tie 1206 via one or more rail platforms 1204. While the depicted embodiment shows the diverging stock rail 1208 on the right and the through stock rail 1210 on the left, the universal slide-plates 1202 may allow the directionality of the switch to be changed by simply changing the relative positions of the universal slide-plates 1202 without changing the position of the ties 1206 and/or rail platforms 1204. For example, diverging stock rail 1208 on the right and the through stock rail 1210 on the left may be reversed by exchanging the universal slide-plates 1202 on the left and right, such that the diverging stock rail 1208 is positioned on the left and the through stock rail 1210 is positioned on the right. The diverging stock rail 1208 and the through stock rail 1210.

The universal slide-plates 1202 are connected to the rail platforms 1204 by one or more retaining members 1238 engaged with a drop-in shoulder member 1220 of the universal slide-plate 1202 and the diverging stock rail 1208 and the through stock rail 1210 are connected to the universal slide-plates 1202 by one or more retaining members 1238 engaged with a first shoulder 1236 on a body 1218 of the universal slide-plate 1202. In some embodiments, the one or more retaining members 1238 may be identical and may be interchangeable between restraining the universal slide-plates 1202 and the diverging stock rail 1208 and the through stock rail 1210. In other embodiments, the one or more retaining members 1238 may be different. The restraining members 1238 of FIG. 12 illustrate an embodiment in which the restraining members 1238 include a loop of resilient material in a single plane, as described herein. A system of universal slide-plates 1202 in accordance with the present disclosure may, therefore, provide a modular support structure upon which a switch may be supported while allowing modifications to the switch with little or no additional or specialized parts.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A device for supporting a rail, the device comprising:
- a body having a top surface, a first end, a second end, a bottom surface, and a forward surface and rearward surface;
- shoulder connected to the top surface proximate the first end of the body;
- a first connection member affixed to the bottom surface and proximate the first end of the body;
- a drop-in shoulder member having a second connection member, a portion of which extends underneath the second end of the body;
- a slide surface on the top surface;
- a stock surface on the top surface, the stock surface being recessed relative the slide surface; and
- a first retaining member configured to connect to the drop-in shoulder and contact the top surface proximate the second end.

2. The device of claim 1, further comprising one or more extensions extending in a downward direction.

3. The device of claim 2, wherein the one or more extensions are connected to the forward or rearward surface.

4. The device of claim 1, wherein the first connection member and second connection member are hooks.

5. The device of claim 1, wherein the first retaining member is a resilient clip.

6. The device of claim 1, further comprising a second retaining member.

7. The device of claim 6, wherein the stock surface is configured to receive a rail and the second retaining member is configured to limit movement of the rail relative to the stock surface.

8. The device of claim 1, wherein the first retaining member is multi-planar.

9. The device of claim 1, further comprising a heating element configured to heat at least the slide surface.

10. A system for supporting a rail, the system comprising:
- a rail platform having a top plate, the top plate having at least two openings therethrough;
- a slide-plate having a body with a top surface configured to support a point rail and a bottom surface with a first connection member, the first connection member configured to mate with either of the at least two openings;

a drop-in shoulder member having a second connection member, a portion of which extends underneath the second end of the body, the second connection member configured to mate with either of the at least two openings, a position of the slide-plate and a position of the drop-in shoulder member being reversible; and a retaining member configured to connect to the drop-in shoulder member and contact the top surface of the body opposite the portion of the second connection member disposed underneath the second end of the body.

11. The system of claim 10, further comprising a steel tie welded to the rail platform and configured to support the rail platform.

12. The system of claim 10, wherein the slide-plate comprises:

a body having a slide surface on a top surface and a stock surface on a top surface, the stock surface being configured to support a rail.

13. The system of claim 10, wherein the body of the slide-plate has a depth that is greater than a depth of the top surface of the rail platform.

14. The system of claim 13, wherein the body of the slide-plate includes one or more extensions that engage the rail platform and limit movement of the slide-plate relative to the rail platform.

15. The system of claim 14, wherein at least one of the one or more extensions is a pin configured to engage with at least one of the plurality of openings.

16. A kit for supporting a rail, the kit comprising: a first straight slide-plate; a second straight slide-plate; a first diverging slide-plate; and a second diverging slide-plate, wherein at least one of the four aforementioned side plates comprises a device for supporting a rail, the device comprising: a body having a top surface, a first end, a second end, a bottom surface, and a forward surface and rearward surface; shoulder connected to the top surface proximate the first end of the body; a first connection member affixed to the bottom surface and proximate the first end of the body; a drop-in shoulder member having a second connection member, a portion of which extends underneath the second end of the body.

17. The kit of claim 16, further comprising a plurality of retaining members configured to engage with the first straight slide-plate, the second straight slide-plate, the first diverging slide-plate, and the second diverging slide-plate.

18. The kit of claim 16, further comprising a third diverging slide-plate and a fourth diverging slide-plate.

19. The kit of claim 16, further comprising one or more rail platforms with a plurality of openings therein, the plurality of openings configured to engage with the first straight slide-plate, the second straight slide-plate, the first diverging slide-plate, and the second diverging slide-plate.

20. The kit of claim 16, further comprising a third straight slide-plate and a fourth straight slide-plate.

* * * * *